United States Patent [19]

Wilcox

[11] Patent Number: 4,674,397

[45] Date of Patent: Jun. 23, 1987

[54] FLUID-OPERATED RECIPROCATING MOTOR

[76] Inventor: Thomas J. Wilcox, 2966 Union St., East Troy, Wis. 53120

[21] Appl. No.: 702,868

[22] Filed: Feb. 21, 1985

[51] Int. Cl.[4] ..... F01B 7/18

[52] U.S. Cl. ..... 91/235; 91/321; 91/395; 91/417 R

[58] Field of Search ..... 91/235, 395, 416, 321, 91/325, 417 A, 417 R, 47, 50, 415; 137/625.61, 625.62

[56] References Cited

U.S. PATENT DOCUMENTS

| | | | |
|---|---|---|---|
| 1,780,817 | 11/1930 | Dubois . | |
| 2,630,181 | 3/1953 | Solum . | |
| 2,789,510 | 4/1957 | Meynig | 91/235 |
| 3,023,739 | 3/1962 | Dickson, Jr. et al. | 91/417 R |
| 3,230,839 | 1/1966 | DeGaston | 91/50 |
| 3,500,735 | 3/1970 | Greene . | |
| 3,524,385 | 8/1970 | Ottestad | 91/416 X |
| 3,757,640 | 9/1973 | Karol | 91/416 X |
| 3,939,755 | 2/1976 | Tabor | 91/235 X |
| 4,031,812 | 6/1977 | Koshelev | 91/235 X |

FOREIGN PATENT DOCUMENTS

| | | | |
|---|---|---|---|
| 273467 | 4/1930 | Italy | 91/321 |
| 0273467 | 4/1930 | Italy | 91/321 |
| 370377 | 4/1973 | U.S.S.R. | 91/416 |
| 1000617 | 3/1983 | U.S.S.R. | 91/325 |

*Primary Examiner*—Edward K. Look

*Attorney, Agent, or Firm*—Glenn A. Buse'

[57] ABSTRACT

The fluid-powered, reciprocating motor includes a cylinder having an inlet chamber and an outlet chamber, a differential area piston mounted in the cylinder, and an output or power shaft connected to the piston. A pressurized fluid, either a gas or a liquid, is continuously introduced into the cylinder inlet chamber and acts on the smaller piston area to move the piston in one direction. A small stream of the fluid flows from the cylinder inlet chamber into the cylinder outlet chamber through a control passage in the piston and is exhausted from the cylinder outlet chamber through an outlet passage until the piston is moved far enough for a valve member carried by the piston to close the outlet passage. Fluid pressure subsequently building up in the cylinder outlet chamber acts on the larger piston area and moves the piston in the opposite direction. The valve member is biased toward an open position by a spring which is compressed as the piston moves in the opposite direction and eventually overcomes the pressure force acting on the valve member to open the valve member and vent pressure from the cylinder outlet chamber so that the cycle can be repeated.

7 Claims, 2 Drawing Figures

FLUID-OPERATED RECIPROCATING MOTOR

This application is a continuation of Ser. No. 520,255 filed Aug. 4, 1983, now abandoned.

BACKGROUND OF THE INVENTION

This invention relates to fluid-powered, reciprocating motors.

Fluid-powered, reciprocating motors are used for a variety of applications including power tools, liquid pumps and the like. In one type of such motors, a piston mounted for reciprocative movement inside a cylinder is driven in one direction by a spring acting on one side of the piston and is driven in the opposite direction by a pressurized liquid or gas acting on the other side of the piston. Flow of the pressurized fluid from the cylinder is controlled by a valve which is opened and closed in response to movement of the piston. Prior constructions for this type fluid-powered pumps are exemplified in U.S. Pat. Nos. 1,780,817, 2,630,181, 2,789,510, and 3,230,839.

Such motors require a relatively large piston return spring which makes it difficult to control piston movement so that the speed and/or power of both strokes is substantially the same.

U.S. Pat. No. 3,500,735 discloses a pneumatic motor which employs pressurized air to power a piston in both directions. However, the motor is designed to operate only on a compressible gas, such as air. Also, the motor requires separate air supplies, one regulated and the other non-regulated.

SUMMARY OF THE INVENTION

An object of the invention is to provide a fluid-powered, reciprocating motor which is simply constructed, has a minimum number of moving parts, and can be operated at relatively low pressures.

Another object of the invention is to provide a fluid-powered, reciprocating motor which can be operated with either pneumatic or hydraulic pressure.

A further object of the invention is to provide a fluid-powered, reciprocating motor which has a single inlet through which a pressurized fluid is continuously introduced and a single outlet, and yet is fluid-powered in both stroke directions.

A still further object of the invention is to provide a fluid-operated, reciprocating motor including a piston and means for conveniently adjusting the piston stroke speed in both directions.

Other objects, aspects and advantages of the invention will become apparent to those skilled in the art upon reviewing the following detailed description, the drawing and the appended claims.

The fluid-powered, reciprocating motor provided by the invention includes a cylinder having inlet and outlet chambers, a differential area piston mounted in the cylinder for reciprocative movement, an output shaft connected to the piston for common reciprocation therewith, an inlet port for introducing a pressurized fluid into the cylinder inlet chamber, a control passage in the piston connecting the cylinder inlet chamber in fluid communication with the cylinder outlet chamber, an outlet passage for exhausting fluid from the cylinder outlet chamber, and a valve member for selectively opening and closing the outlet passage. The valve member is operable to close the outlet passage in response to the piston moving a predetermined distance in one direction and to open the outlet passage in response to the piston moving a predetermined distance in the opposite direction.

A portion of the pressurized fluid introduced through the inlet passage acts on the smaller piston area and moves the piston in one direction while another small portion of the fluid passes through the control passage and exits from the cylinder outlet chamber through the outlet passage until the valve member is moved to the closed position. The fluid pressure thereafter building up in the cylinder outlet chamber acts on the larger piston area and moves the piston in the opposite direction until the valve member opens and the pressure force acting on the larger area of piston drops below the pressure force acting on the smaller area of the piston so that the cycle can be repeated.

In one embodiment, means are provided for adjusting the flow area of the control passage and thereby adjusting the stroke speed of the piston.

In one embodiment, the motor includes a valve seat adapted to be engaged by the valve member for closing the outlet passage, the valve member is mounted for axial movement relative to the valve seat between the open and closed positions, and the valve member is biased toward the open position.

In one embodiment, the outlet passage includes an annular seat, the valve member is adapted to sealingly engage the valve seat and close the outlet passage, the piston includes an elongated valve guide extending coaxially with and adapted to extend into the outlet passage, the valve member is slidably carried on the valve guide for axial movement relative to the valve seat between the closed position and an open position axially displaced from the valve seat, and coil spring surrounding the valve guide biases the valve member toward the open position. The valve member has an inner surface which faces the cylinder outlet chamber when in the closed position such that, as the piston starts moving in the opposite direction, the spring is compressed and the fluid pressure force acting on this inner surface maintains the valve member in the closed position until the biasing force of the spring exceeds that pressure force.

DESCRIPTION OF THE PREFERRED EMBODIMENTS

Figure 1:
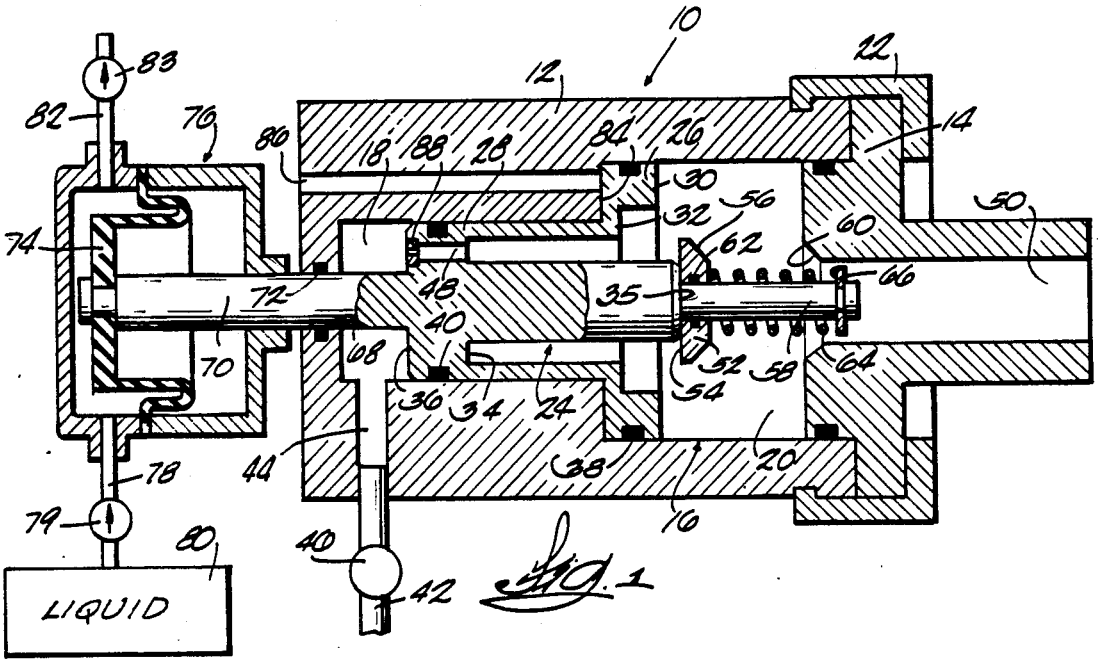
FIG. 1 is a sectioned, partially schematic, side elevation view of a fluid-powered, reciprocating motor embodying the invention, shown connected to a liquid injection pump and with the piston at the end of one stroke.

A fluid-powered, reciprocating motor of the invention can be adapted to drive a wide variety of devices. It is particularly adapted for use in driving a diaphragm type pump for pumping liquids and will be described in connection with that application.

The drawing illustrates a fluid-powered, reciprocating motor 10 including a generally cylindrical housing 12 closed at one end by an end cap 14 and defining a differential cylinder 16 including an inlet chamber 18 and an outlet chamber 20 which has a cross sectional area larger than that of the inlet chamber 18. The end cap 14 is removably installed on the housing 12 by suitable fastening means, such as an assembly ring 22.

Mounted in the cylinder 16 for reciprocative movement is a differential piston 24 having an enlarged portion 26 disposed in the cylinder outlet chamber 20 and a smaller portion 28 of reduced cross section disposed in the cylinder inlet chamber 18. The total pressure area of the outlet side of the piston 24, i.e., the total area of surfaces 30, 32, 34 and 35, facing the cylinder outlet chamber 20 is somewhat larger than the total pressure area of the inlet side of the piston, i.e., the total area of surface 36, facing the cylinder inlet chamber 18.

O-rings 38 and 40 or other suitable sealing means carried on the outer periphery of respective piston portions 26 and 28 form slidable, fluid-tight seals between the piston and the cylinder walls. Such seals can be omitted when the piston and/or housing is made from a low friction material, such as a synthetic plastic, and/or a low pressure operating fluid is used.

The motor 10 is operated by a pressurized fluid, either a substantially incompressible liquid, such as water or hydraulic fluid, or a compressible gas, such as air. The fluid, which can be at a relatively low pressure, e.g., about 20 psig or lower, is continuously introduced into the cylinder inlet chamber 18 through a conduit 42 connected to a suitable fluid source (not shown) and to an inlet passage 44 in the housing 12. Flow of the incoming fluid is controlled by a valve 46 in the conduit 42.

A relatively small flow of the fluid entering the cylinder inlet chamber 18 flows into the cylinder outlet chamber 20 through a small control passage 48 extending axially through the piston 24 and connecting the two cylinder chambers in the fluid communication.

Fluid in the cylinder outlet chamber 20 is exhausted therefrom through an outlet passage 50 in the end cap 14. Fluid flow through the outlet passage 50 is selectively controlled by a valve arranged to move from an open position to the closed position in response to the piston 24 moving a predetermined distance in a direction toward the outlet end of the cylinder 16 and to move back to the open position in response to the piston 24 moving a predetermined distance in an opposition toward the inlet end of the cylinder 16.

While various suitable valve arrangements can be used, in the specific construction illustrated, a valve disc or poppet 52 having an inner surface 54 and a tapered seating surface 56 is slidably carried on a generally cylindrical valve guide 58 extending from the outlet side of the enlarged portion 26 coaxially with the outlet passage 50. The outer diameter of the valve guide 58 is somewhat smaller than the inside diameter of the outlet passage 50 so that the valve guide 58 can extend into the outlet passage 50 during operation of the motor.

The tapered seating surface 56 of the poppet 52 engages a complementary annular valve seat 60 surrounding the inner end of the outlet passage 50 and shuts off flow through the outlet passage 50. In this regard an O-ring 62 or other suitable sealing means carried on the inner periphery of the poppet 52 forms a slidable, fluid-tight seal between the poppet 52 and the valve guide 58.

The poppet 52 is biased in a direction away from the valve seat 60, i.e., toward an open position, by a coil spring 64 surrounding the valve guide 58 with one end bearing against the poppet 52 and the opposite end bearing against a spring retainer 66 carried on the outer end portion of the valve guide 58.

Connected to the smaller piston portion 28 and slidably extending through an aperture 68 in the end of the housing 12 is a power or output shaft 70 which reciprocates with the piston 24. An O-ring 72 or other suitable sealing means forms a slidable, fluid-tight seal between the output shaft 70 and the aperture wall.

In the specific embodiment illustrated, the output shaft 70 is connected to the diaphragm 74 of a conventional diaphragm type pump 76. A liquid, such as water, is drawn through an inlet 78 and a check valve 79 from a suitable source 80 and pumped out through an outlet 82 and a check valve 83 in response to reciprocative movement of the diaphragm 74 by the output shaft 70.

Figure 2:
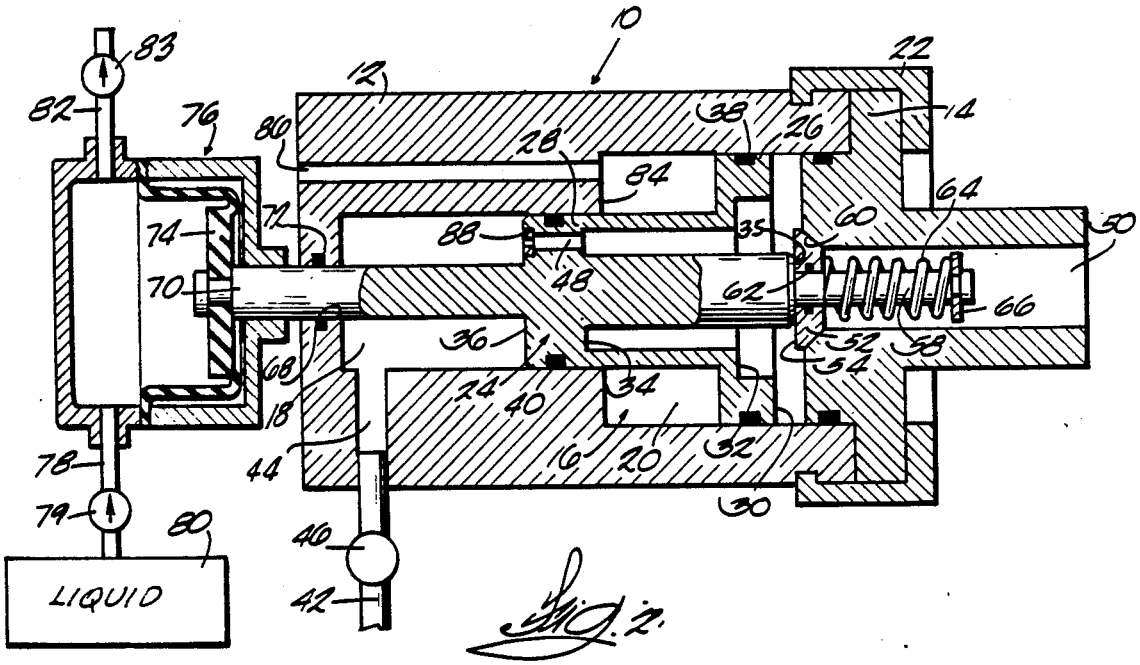
FIG. 2 is a view similar to FIG. 1 shown with the piston at the end of the other stroke.

Operation of the motor 10 will be explained starting with the piston 24 in the position shown in FIG. 1. A stream of fluid is continuously admitted into the cylinder inlet chamber 18 through the inlet passage 44. Fluid pressure acting on the surface 36 forces the piston 24 to the right and, as the piston 24 moves to the right, a small stream of fluid flows through the control passage 48 in the piston 24. Fluid entering the cylinder outlet chamber 20 exits through the outlet passage 50 until the piston 24 is moved to a position where the poppet 52 is forced into sealing engagement with the valve seat 60 as shown in FIG. 2. As the poppet 52 is moved near the valve seat 60, the fluid pressure acting on the inner surface 54 of the poppet 52 overcomes the biasing force of the spring 64 and seats the poppet against the valve seat 60.

After the poppet 52 closes the outlet passage 50, fluid pressure builds up in the cylinder outlet chamber 20 and acts on the surfaces 30, 32, 34 and 35 on the outlet side of the piston 24 to start moving the piston 24 to the left. This occurs, even though fluid at the same pressure is present in the cylinder inlet chamber 18, because the total pressure area of the outlet side of the piston 24 is greater than the total pressure area of the inlet side of the piston 24. As the piston 24 starts moving to the left, fluid pressure acting on the inner surface 54 of the poppet 52 maintains it in the closed position and the spring 64 is compressed. The poppet 52 is opened when the biasing force of the spring 64 overcomes the pressure force acting on the inner surface 54 of the poppet 52.

As the piston 24 moves to the left, any fluid which has leaked past O-rings 38 and/or O-ring 40 and is trapped between the enlarged piston portion 26 and a shoulder 84 separating the cylinder inlet and outlet chambers is vented from the housing 12 through a vent passage 86 which is open to the atmosphere.

Thus, the vent passage 86 serves as a leak detector because fluid squirting from the vent passage 86 indicates seal leakage. The vent passage 86 also serves to prevent an air lock behind the enlarged piston portion.

Once the poppet 52 opens, fluid in the cylinder outlet chamber 20 immediately starts flowing through the outlet passage 50 and the pressure in the cylinder outlet chamber 20 eventually decreases to a level where the pressure force acting on the outlet side at the piston 24 is less than that acting on the inlet side and the cycle can be repeated. During this time the spring 64 returns the poppet 52 to the starting position shown in FIG. 1.

The relative speed of the piston 24 for each stroke can be conveniently controlled by varying the flow area of the control passage 48. For example, when this flow area is made larger, a larger portion of fluid bleeds from the cylinder inlet chamber 18 to the cylinder outlet chamber 20, causing the piston 24 to move at a slower speed to the right. On the other hand, the larger flow area permits more rapid pressure build-up in the cylinder outlet chamber 20 after the poppet 52 closes, causing the piston 24 to move at a higher speed to the left.

Reducing the flow area of the control passage produces the opposite effect.

Suitable means preferably are provided for selectively adjusting the flow area of the control passage 48. In the specific embodiment illustrated, such means includes an orifice plate 88 removably mounted on the inlet side of the piston 24. The relative speed of the piston strokes can be adjusted by replacing the orifice plate 88 with one having the appropriate size opening.

Since the fluid pressure acting on both sides of the piston comes from a single source, varying the inlet pressure, such as by adjusting the valve 46, will have the same effect on the speed and/or power of both piston strokes.

From the above description, it can be seen that the fluid-powered, reciprocating motor of the invention has several advantages. Even though it is simply constructed and has a minimum number of moving parts, it can be operated with either pneumatic or hydraulic pressure at a relatively low level. It does not require a spring to return the piston in one direction and has only one fluid inlet and one fluid outlet. Thus, varying the inlet pressure has substantially the same effect on the speed and/or power of both piston strokes. The relative speed and/or power of the piston strokes can be conveniently adjusted.

From the foregoing description, one skilled in the art can easily ascertain the essential characteristics of the invention and, without departing from the spirit and scope thereof, make various changes and modifications to adapt it to various usages.

I claim:

1. A fluid-powered, reciprocating motor comprising a housing defining a cylinder having an inlet chamber and an outlet chamber, a piston mounted for reciprocative movement within said cylinder, said piston including a first portion exposed to said inlet chamber and having a first pressure area and a second portion exposed to said outlet chamber and having a second pressure area larger than said first pressure area;

an output shaft connected to said piston for common reciprocation therewith;

an inlet passage connected to a source of pressurized fluid for continuously introducing the pressurized fluid only into said cylinder inlet chamber during operation of said motor, a control passage in said piston continuously connecting said cylinder inlet chamber in fluid communication with said cylinder outlet chamber;

an outlet passage for rapidly exhausting the fluid from said cylinder outlet chamber; and a movable valve member for selectively opening and closing said outlet passage, said valve member being operable to close said outlet passage in response to said piston moving a predetermined distance in one direction and to open said outlet passage in response to said piston moving a predetermined distance in the opposite direction, whereby a portion of the pressurized fluid introduced into said cylinder inlet chamber acts on said first pressure area and moves said piston in said one direction while another portion of the pressurized fluid passes through said control passage and exits from said cylinder outlet chamber through said outlet passage until said valve member is moved to the closed position in response to movement of said piston and the fluid pressure thereafter builds up in said cylinder outlet chamber and acts on said second pressure area to move said piston in the opposite direction until said valve member opens in response to movement of said piston and the pressure force acting on said second pressure area of said piston drops below the pressure force acting on said first pressure area of said piston to permit the cycle to be repeated.

2. A fluid-powered, reciprocating motor according to claim 1 including means for selectively adjusting the flow area of said control passage.

3. A fluid-powered, reciprocating motor according to claim 1 including a valve seat adapted to be sealingly engaged by said valve member for closing said outlet passage;

means on said piston carrying said valve member for movement relative to said seat between the closed position and an open position displaced from said valve seat; and means biasing said valve member toward the open position.

4. A fluid-powered, reciprocating motor according to claim 3 wherein said valve member carrying means includes an elongated valve guide extending from said piston coaxially with said outlet passage;

said valve member is slidably carried on said valve guide for axial movement relative to said valve seat between the open and closed positions; and said biasing means comprises a spring carried by said valve guide.

5. A fluid-powered, reciprocating motor according to claim 4 wherein said valve member has an inner surface facing said cylinder outlet chamber when said valve member is in the closed position such that, as said piston starts moving in said opposite direction, said spring is compressed and the fluid pressure force acting on said inner surface maintains said valve member in the closed position until the biasing force of said spring exceeds that pressure force.

6. A fluid-powered, reciprocating motor according to claim 1 wherein said outlet passage includes an annular valve seat;

said valve member is adapted to sealingly engage said valve seat and close said outlet passage;

said piston includes an elongated valve guide extending coaxially with and adapted to extend into said outlet passage;

said valve member is slidably carried on said valve guide for axial movement relative to said valve seat between the closed position and an open open position axially displaced fromm said valve seat;

said motor includes a coil spring surrounding said valve guide for biasing said valve member toward the open position; and said valve member has an inner surface facing said cylinder outlet chamber when said valve member is in the closed position such that, as said piston starts moving in said opposite direction, said spring is compressed and the fluid pressure acting on said inner surface maintains said valve member in the closed position until the biasing force of said spring exceeds that pressure force.

7. A fluid-powered, reciprocating motor according to claim 1 wherein fluid pressure acting on said first and second pressure areas is the sole means for moving said piston in both directions.

* * * * *